United States Patent [19]

Nadin

[11] Patent Number: 4,954,093

[45] Date of Patent: Sep. 4, 1990

[54] SHUNT CONNECTION DEVICE FOR ELECTRICAL CONNECTORS

[75] Inventor: Leonard Nadin, L'Union, France

[73] Assignee: Labinal, Montigny le Bretonneux, France

[21] Appl. No.: 343,603

[22] Filed: Apr. 27, 1989

[30] Foreign Application Priority Data

May 11, 1988 [FR] France ..... 8806397

[51] Int. Cl.[5] ..... H01R 29/00

[52] U.S. Cl. ..... 439/188; 439/189; 439/507; 439/512; 439/514

[58] Field of Search ..... 439/188, 189, 507, 509–515

[56] References Cited

U.S. PATENT DOCUMENTS

| | | | |
|---|---|---|---|
| 4,274,691 | 6/1981 | Abernethy et al. | 439/507 |
| 4,501,459 | 2/1985 | Chandler et al. | 439/514 |
| 4,671,599 | 6/1987 | Olsson | 439/188 |
| 4,693,531 | 9/1987 | Raphal et al. | 439/512 |
| 4,786,258 | 11/1988 | Shaffer et al. | 439/188 |

*Primary Examiner*—P. Austin Bradley

*Attorney, Agent, or Firm*—Sandler, Greenblum & Bernstein

[57] ABSTRACT

An electrical connector comprises a first casing member in which is a series of housings each adapted to receive a respective one of a plurality of male contact members each incorporating a tang. The connector further comprises a second casing member complementary to the first casing member in which are a series of housings each adapted to receive a respective female contact member each adapted to cooperate with the tang on a respective male contact member to make an electrical connection. The connector further comprises a plurality of connection channels each adapted to have a tang passed through it and a shunt module adapted to receive these electrical connection channels. The shunt module comprises an insulative material body and a series of passages adapted to coincide with respective housings of the first casing member and to receive a respective electrical connection channel. A skirt on one casing member is adapted to receive the shunt module. At least two of the electrical connection channels in the shunt module are electrically interconnected to make a shunt connection.

14 Claims, 5 Drawing Sheets

SHUNT CONNECTION DEVICE FOR ELECTRICAL CONNECTORS

BACKGROUND OF THE INVENTION

1. Field of the invention

The present invention concerns electrical connectors comprising a first casing member with male contact members and a second casing member with female contact members, the two casing members being adapted to fit together so that the male members cooperate with the female members to provide electrical continuity.

2. Description of the prior art

Connectors of this kind are used in many industries and in particular in the automobile industry, and they are generally fitted to the ends of previously prepared electrical conductor harnesses.

In harnesses of this kind, other conductors are "spliced" to certain conductors to constitute branch connections providing other electrical functions. The "splicing" of these additional conductors constitutes a task which is very difficult to achieve from the mechanical point of view.

One object of the present invention is to eliminate such splicing.

SUMMARY OF THE INVENTION

The present invention consists of, in an electrical connector comprising a first casing member, a plurality of male contact members each incorporating a tang, a series of housings in the first casing member each adapted to receive a respective male contact member, a second casing member complementary to the first casing member, a plurality of female contact members adapted to cooperate with the tang on a respective male contact member to make an electrical connection and a series of housings in the second casing member each adapted to receive a respective female contact member, a shunt connection device comprising a plurality of electrical connection channels each adapted to have a tang pass through it and a shunt module adapted to receive the electrical connection channels and comprising an insulative material body and a series of passages adapted to coincide with respective housings of the first casing member and to receive a respective electrical connection channel, in which shunt module at least two of the electrical connection channels are electrically interconnected to provide a shunt connection, the connector further comprising a skirt on one casing member adapted to receive said shunt module.

In this way it is a simple matter to connect electrically at least two male contact member tangs, one being linked to a female contact member whereas the other may be free. In this way splicing is entirely eliminated and the wiring can be done entirely automatically by machine.

The electrical connection channels are preferably made from a strip of highly conductive metal which is cut to form a series of H-shaped holes delimiting two tangs which are bent towards one side of the strip to form the channels, the marginal bands at either side of the channels serving to interconnect the channels electrically and being adapted to be cut selectively according to the shunt connections required.

Two opposite portions of the interior of the skirt preferably comprise abutment members and the shunt module preferably comprises resilient lugs adapted to cooperate with the abutment members to lock the shunt module into the skirt.

In a preferred embodiment of the invention the first and second casing members each comprise two superposed series of housings, the shunt module comprises two superposed series of passages and the electrical connection channels adapted to be received into the passages of one series are aligned and interconnected by a respective marginal band and the connector further comprises an intermediate band by which the marginal bands are electrically interconnected.

The electrical connection channels are preferably made from a strip of highly conductive metal which is cut to form two series of H-shaped holes, a band between the holes and elongate openings in a middle portion of the band and the tangs delimited by the H-shaped holes is bent to form two series of electrical connection channels and the strip is bent into an U-shape so that the electrical connection channels are in opposed relationship in two parallel planes and the marginal bands between each series of electrical connection channels and the corresponding edge of the strip are bent under the electrical connection channels.

Each passage preferably comprises a resilient lug for retaining the respective electrical connection channel.

Finally, at least one of the casing members could be of a type comprising a compartment adapted to receive an insert comprising the series of housings each adapted to receive a contact member.

The invention will now be described in more detail and by way of example only with reference to a specific embodiment shown in the appended drawings.

DESCRIPTION OF THE PREFERRED EMBODIMENT

Figure 1:
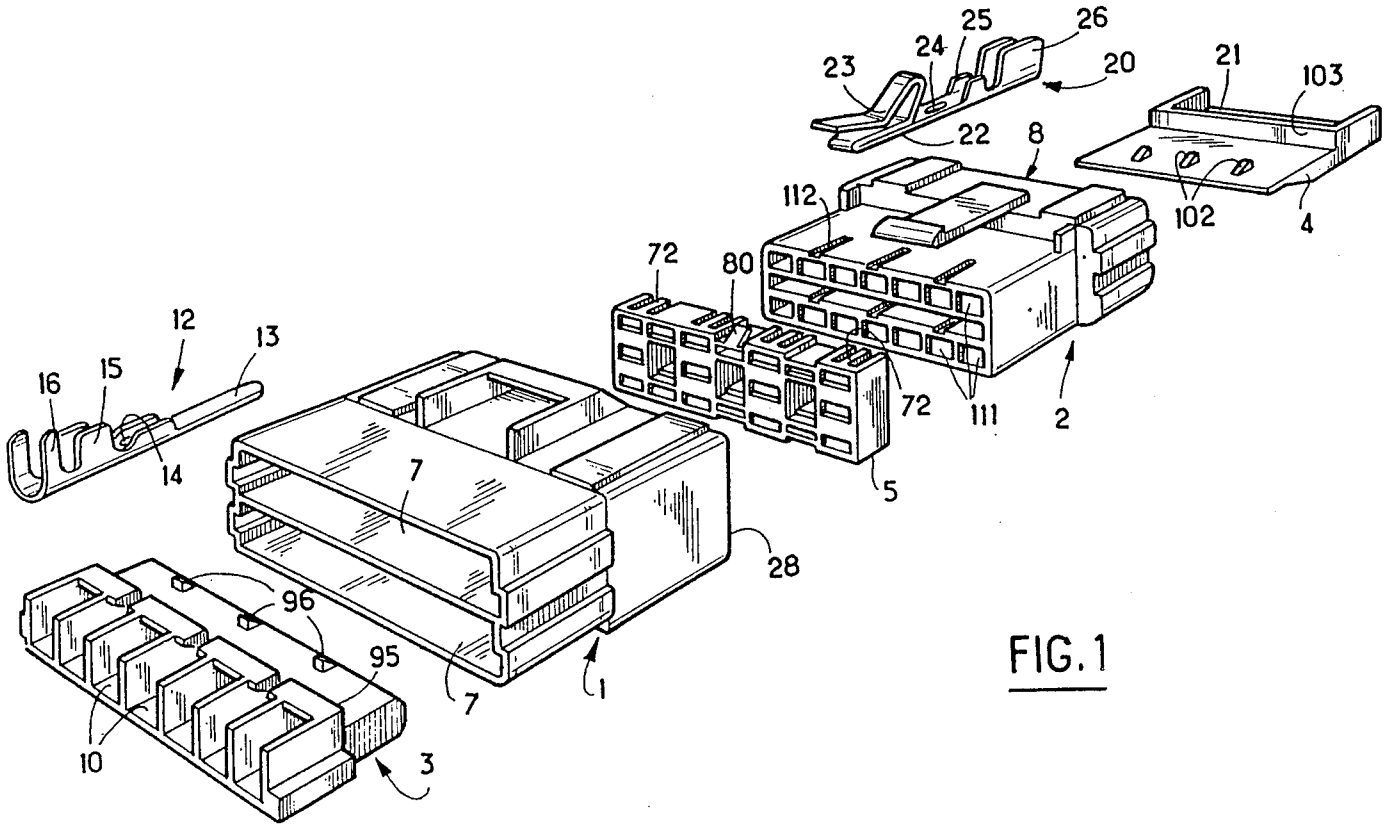
FIG. 1 is an exploded view in perspective of a connector fitted with a shunt device in accordance with the invention.
Figure 2:
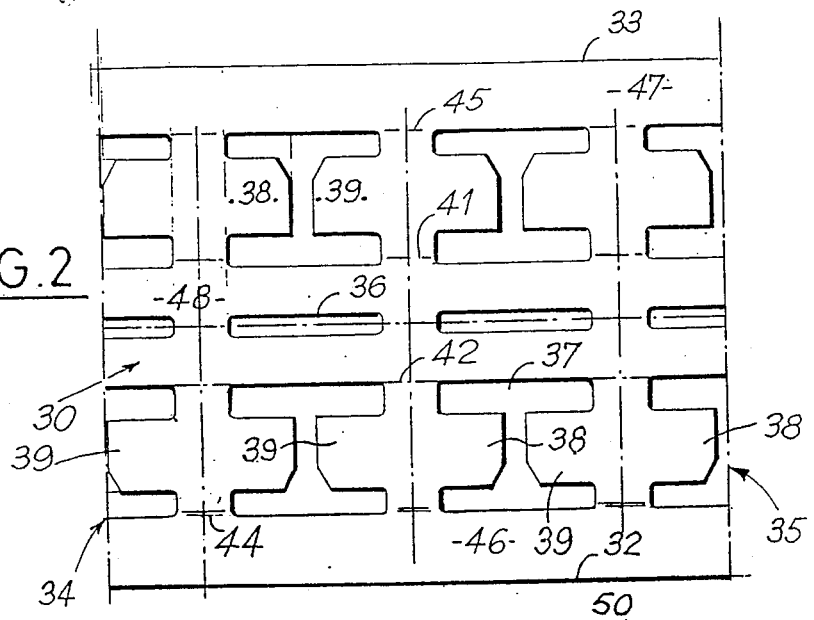
FIG. 2 is a plan view of a cut strip adapted to form the conductor of the shunt device in accordance with the invention after cutting but before bending.

FIG. 1 is an exploded perspective view of an electrical connector fitted with a shunt device in accordance with the invention and comprising a female casing 1, a complementary male casing 2, two inserts 3 adapted to be received in a compartment 7 of the female casing 1 and two inserts 4 adapted to be received in a compartment 8 of the male casing 2. To make FIG. 1 clearer only one of each of the inserts 3 and 4 has been shown.

Each insert 3 is divided into a series of housings 10, with each adapted to receive a male contact member 12 incorporating a bar 13, lugs 15 for crimping onto the conductive core of a previously stripped electrical conductor and lugs 16 for crimping onto the insulation of the conductor, a hole 14 being also provided in said male contact member 12.

Each insert 4 is divided into a number of housings 21, with each corresponding to one of the housings 10 and each adapted to receive a female contact member 20. The female contact member 20 comprises lugs 25 for crimping onto the core of a stripped electrical conductor, lugs 26 for crimping onto the conductor and an extension 22 folded into a clamp 23 for gripping the bar 13 elastically.

The female contact member 20 could be of some other type, for example with a U-shaped housing, the free ends of the branches being inwardly folded and adapted with the core of the U to grip the bar 13.

Similarly, the bars 13 could be cylindrical and the female contacts have a corresponding shape.

A shunt module 5 is housed in a skirt 28 of the female casing 1.

The shunt module 5 is shown in detail in FIGS. 2 through 8 and comprises an insulative suppport 55 and a connecting strip 30.

The connecting strip 30 (see FIGS. 2, 3 and 4) is made from a generally rectangular blank which is a good conductor of electricity with two longer sides 32 and 33 and two shorter sides 34 and 35.

Into the middle part are cut elongate holes 36 and symmetrically relative to the latter H-shaped holes 37 which delimit two tangs 38 and 39.

Figure 3:
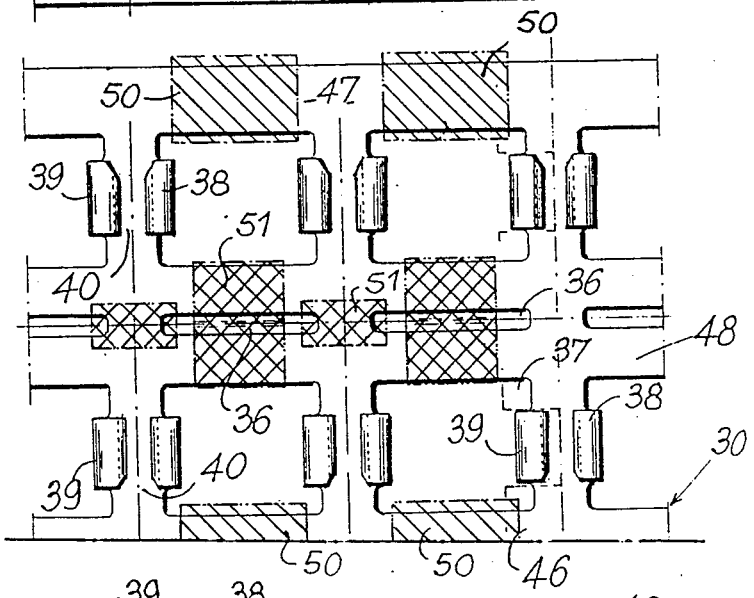
FIG. 3 is a plan view showing various possibilities for cutting the strip.
Figure 4:
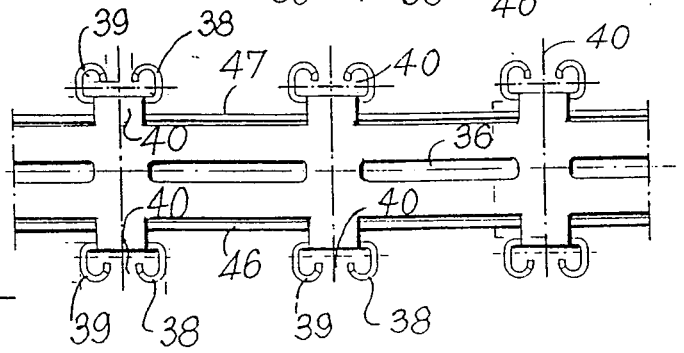
FIG. 4 shows the strip finally obtained.
Figure 5:
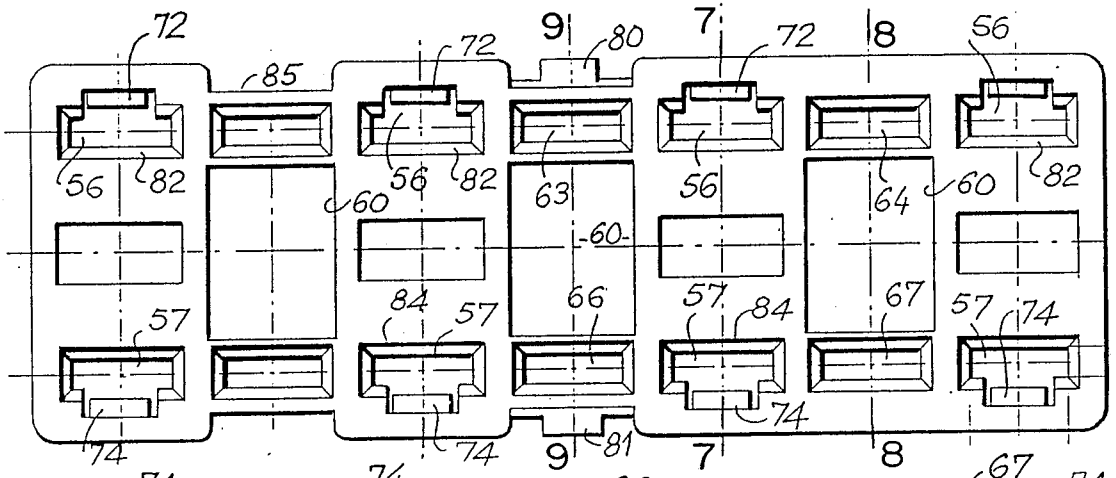
FIG. 5 is a view in elevation from the front of the shunt module adapted to receive the strip from FIGS. 2 through 4.
Figure 6:
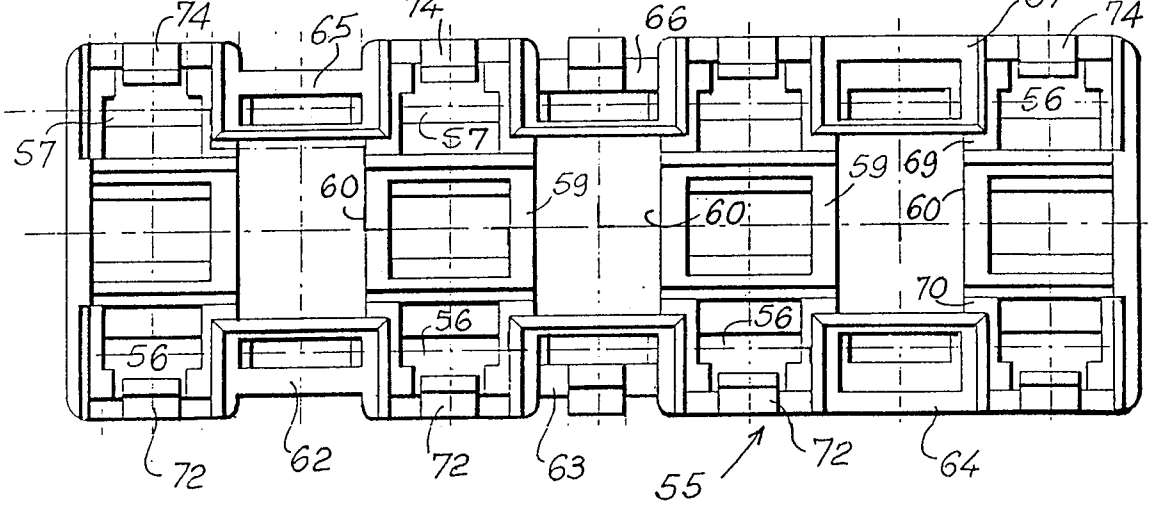
FIG. 6 is a view in elevation of the back of the shunt module from FIG. 5.
Figure 8:
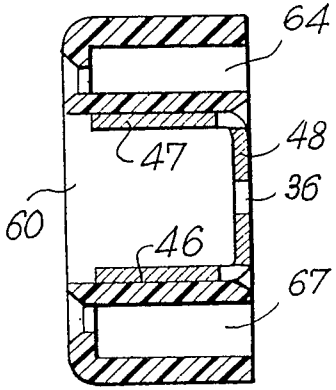
FIG. 8 is a view in cross-section on the line 8—8 in FIG. 5.

As seen in FIG. 3, each tang 38 is bent towards one side of the blank and each tang 39 is bent to the same side and towards the tang 38 of the adjacent H-shaped hole so as to form an electrical connection channel 40.

The blank is then folded into a U-shape along two lines 41 and 42 passing through the edge of the holes 37 adjacent the holes 36 so that the electrical connection channels 40 lie on two parallel lines perpendicular to a core 48.

The marginal band 46 situated between the edge of the holes 37 and the longer side 32 is bent along a line 44 so as to lie under one of the rows of electrical connection channels 40.

The marginal band 47 situated between the edge of the holes 37 and the long side 33 is bent along a line 45 to extend under the second row of channels 40.

Areas 50 may be cut selectively during manufacture of the connecting strip 30.

Areas 51 may be cut selectively after the connecting strip 30 has been fitted into the shunt module 5.

The shunt module 5 comprises an insulative material body 55 shaped to define a series of passages 56 each adapted to receive an electrical connecting channel 40 of one row on the connecting strip 30.

The body 55 comprises a second series of passages 57 adapted to receive the electrical connection channels 40 of the second row.

The central part of the body 55 comprises between a passage 56 and the corresponding passage 57 a box-section 59 against which the core 48 bears. Large holes 60 are provided between the box-sections 59.

The passages 56 are interconnected by box-sections 62, 63 and 64 and the passages 57 are interconnected by box-sections 65, 66 and 67.

Between the box-sections 62, 63 and 64 and the box-sections 59 is a groove 69 in which the marginal band 47 is housed, a similar groove 70 being provided between the box-sections 65, 66 and 67 and the box-sections 59 for the marginal band 46.

Each passage 56 comprises an elastic lug 72 ending in a hook 73.

Each passage 57 is likewise provided with an elastic lug 74 ending with a hook 75. Thus when the connecting strip 30 is fitted the lugs 72 and 74 move apart elastically to enable the electrical connecting channels 40 to be inserted into the passages 56 and 57 and when the channels are in place the hooks 73 and 75 cooperate with the corresponding ends of the channels to lock the connecting strip into the module.

Figure 9:
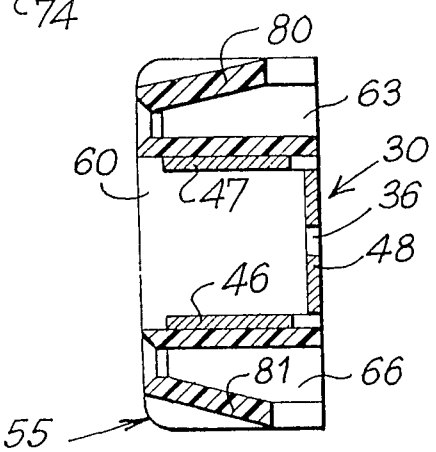
FIG. 9 is a view in cross-section on the line 9—9 in FIG. 5.
Figure 7:
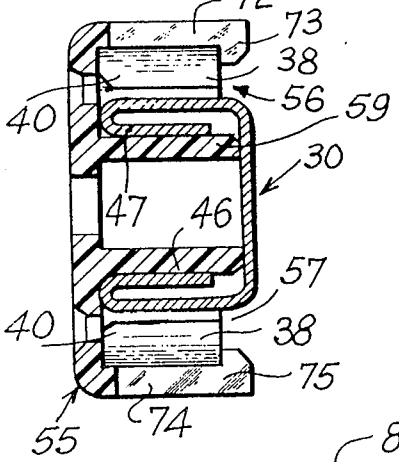
FIG. 7 is a view in cross-section on the line 7—7 in FIG. 5.

The body 55 comprises two locking tabs 80 and 81 (see FIG. 9).

On the side opposite the hook 73 the passages 56 comprise a slot 82 for the tangs 13 to pass through.

The passages 57 comprise slots 84 corresponding to the slots 82.

The body 55 comprises notches 85 near one end and adapted to cooperate with projections 86 on the skirt 28 so that the shunt module can only be fitted one way round.

Figure 10:
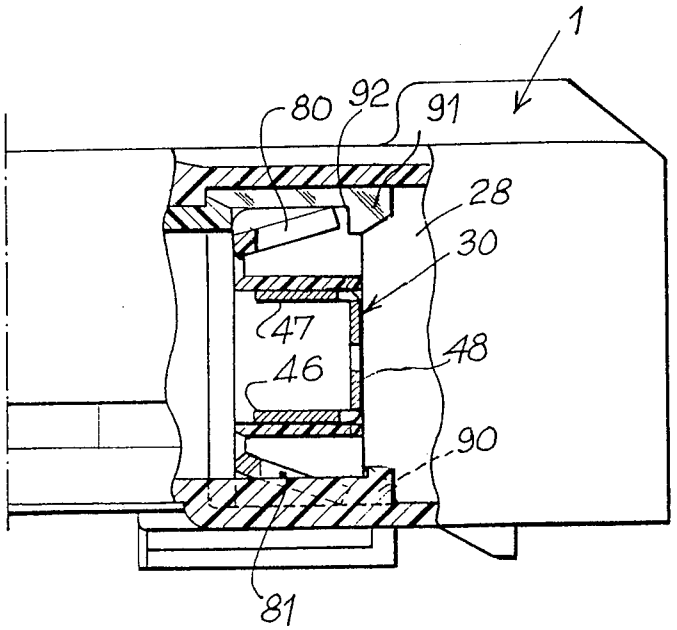
FIG. 10 is a view of the female casing partly in cross-section.
Figure 11:
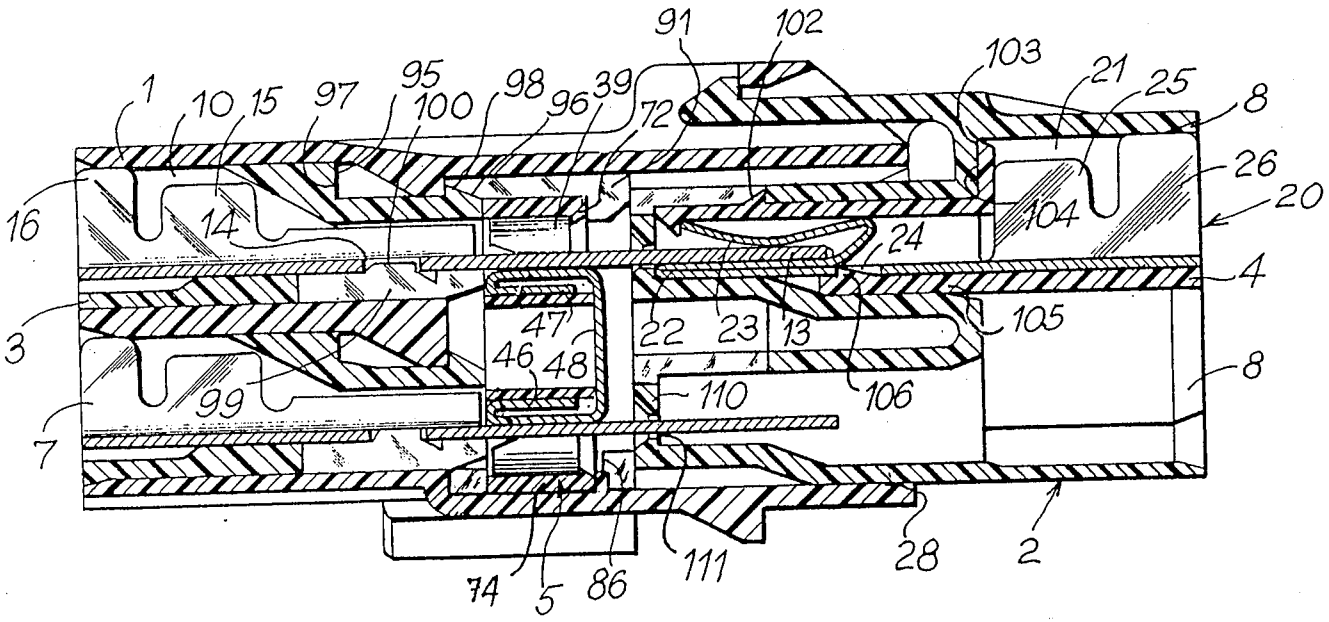
FIG. 11 is a view of the assembled casing in axial cross-section.

As seen in FIG. 10, the skirt 28 of the casing 1 comprises on one side a shoulder 90 and on the opposite side a ramp 91 with a shoulder 92.

To install the shunt module 5 it is inserted into the skirt 28. The elastic lug 81 bears against the shoulder 90 so as to be retracted and to lock against the latter. The lug 80 bears against the ramp 91 so as to be retracted elastically until its free end bears against the shoulder 92.

The insert 3 is provided with a shoulder 95 and abutment members 96. The shoulder 95 is adapted to bear against a corresponding shoulder 97 of the compartment 7 to limit its insertion. The abutment members 96 cooperate with a shoulder 98 to oppose withdrawal of the insert once fitted.

Each housing 10 is provided with a spring tang 99 with a peg 100 adapted to cooperate with the hole 14 so that once it is inserted into the housing the male contact member 12 is locked in place.

The bar 13 of each member 12 passes through a channel 40 and is consequently electrically connected to the connecting strip 30.

At the end opposite that comprising the compartments 8, the male casing 2 is closed by a partition wall 110 pierced by slots 111 for the bars 13 to pass through. The insert 4 comprising a shoulder 103 adapted to bear against a shoulder 104 of the housing 8 to limit the insertion and abutment members 102 adapted to cooperate with the back of the slots 112 in the casing 2 to block the inserts and oppose their withdrawal.

Each housing 21 of an insert 4 comprises an elastic lug 105 provided with a pin 106 which by cooperating with the hole 24 locks the female contact member 20 in place.

It will be readily understood that before fitting the connecting strip 30 selected areas 50 are cut, according to the shunt connections to be made, and that when the strip is fitted the corresponding areas 51 are cut so that two channels 40, or three channels 40, or four channels 40, etc. . . . are electrically interconnected.

According to the electrical connections to be made some housings 21 of the inserts 4 may not have any members 20 while the male tangs 13 of the corresponding housings 10 may be electrically connected by the shunt device in accordance with the invention.

The invention greatly facilitates the making of shunt connections in wiring systems and makes it possible to dispense with the splicing of conductors.

Of course, the invention is not limited to the embodiment that has just been described and shown. Numerous modifications of detail may be made thereto without thereby departing from the scope of the invention.

There is claimed:

1. A shunt connection device for an electrical connector, said electrical connector comprising a first casing member, a plurality of male contact members each incorporating a tang, a series of housings in said first casing member each adapted to receive a respective male contact member, a second casing member complementary to said first casing member, a plurality of female contact members each adapted to cooperate with a tang on a respective male contact member to make an electrical connection and a series of housings in said second casing member each adapted to receive a respective female contact member; said shunt connection device comprising a plurality of electrical connection channels each adapted to have a tang pass through it and a shunt module adapted to receive said electrical connection channels and comprising an insulative material body and a series of passages adapted to coincide with the respective housings of said first casing member and to receive a respective electrical connection channel, in which shunt module at least two of said electrical connection channels are electrically interconnected to provide a shunt connection, the connector further comprising a skirt on one casing member adapted to receive said shunt module.

2. Device according to claim 1 wherein two opposite portions of the interior of said skirt comprise abutment members and said shunt module comprises resilient lugs adapted to cooperate with said abutment members to lock said shunt module into said skirt.

3. Device according to claim 1 wherein said electrical connection channels are made from a strip of highly conductive metal which is cut to form a series of H-shaped holes delimiting two tangs which are bent towards one side of said strip to form said channels, with marginal bands to either side of said channels, serving to interconnect said channels electrically and being adapted to be cut selectively according to shunt connections required.

4. Device according to claim 3 wherein said first and second casing members each comprise two superposed series of housings, said shunt module comprises two superposed series of passages and said electrical connection channels adapted to be received into the passages of one series are aligned and interconnected by a respective marginal band and further comprising an intermediate band by which said marginal bands are electrically interconnected.

5. Device according to claim 4 wherein said electrical connection channels are made from a strip of highly conductive metal which is cut to form two series of H-shaped holes, a band between said holes and elongate openings in a middle portion of said band and said tangs delimited by said H-shaped holes are bent to form two series of electrical connection channels and said strip is bent into a U-shape so that said electrical connection channels are in opposed relationship in two parallel planes and the marginal bands between each series of electrical connection channels and the corresponding edge of the strip are bent under said electrical connection channels.

6. Device according to claim 4 wherein each passage comprises a resilient lug for retaining the respective electrical connection channel.

7. Device according to claim 4 wherein at least one of said casing members is of a type comprising a compartment adapted to receive an insert comprising the series of housings each adapted to receive a contact member.

8. An electrical connector comprising a first casing member, a plurality of male contact members each incorporating a tang, a series of housings in said first casing member each adapted to receive a respective male contact member, a second casing member complementary to said first casing member, a plurality of female contact members each adapted to cooperate with a tang on a respective male contact member to make an electrical connection, a series of housings in said second casing member each adapted to receive a respective female contact member, a shunt connection device comprising a plurality of electrical connection channels each adapted to have a tang pass through it and a shunt module adapted to receive said electrical connection channels and comprising an insulative material body and a series of passages adapted to coincide with the respective housings of said first casing member and to receive a respective electrical connection channel, in which shunt module at least two of said electrical connection channels are electrically interconnected to provide a shunt connection, and a skirt on one casing member adapted to receive said shunt module.

9. Connector according to claim 8 wherein two opposite portions of the interior of said skirt comprise abutment members and said shunt module comprises resilient lugs adapted to cooperate with said abutment members to lock said shunt module into said skirt.

10. Connector according to claim 8 wherein said electrical connection channels are made from a strip of highly conductive metal which is cut to form a series of H-shaped holes delimiting two tangs which are bent towards one side of said strip to form said channels, with marginal bands to either side of said channels, serving to interconnect said channels electrically and being adapted to be cut selectively according to shunt connections required.

11. Connector according to claim 10 wherein said first and second casing members each comprise two superposed series of housings, said shunt module comprises two superposed series of passages and said electrical connection channels adapted to be received into the passages of one series are aligned and interconnected by a respective marginal band and further comprising an intermediate band by which said marginal bands are electrically interconnected.

12. Connector according to claim 11 wherein said electrical connection channels are made from a strip of highly conductive metal which is cut to form two series of H-shaped holes, a band between said holes and elongate openings in a middle portion of said band and said tangs delimited by said H-shaped holes are bent to form two series of electrical connection channels and said strip is bent into a U-shape so that said electrical connection channels are in opposed relationship in two parallel planes and the marginal bands between each series of electrical connection channels and the corresponding edge of the strip are bent under said electrical connection channels.

13. Connector according to claim 11 wherein each passage comprises a resilient lug for retaining the respective electrical connection channel.

14. Connector according to claim 11 wherein at least one of said casing members is of a type comprising a compartment adapted to receive an insert comprising the series of housings each adapted to receive a contact member.

* * * * *